250-201

/29/83 OR 4,418,279

United States Patent [19]

Hager et al.

[11] 4,418,279

[45] Nov. 29, 1983

[54] AUTOMATIC CRT EXPOSURE REGULATION

[75] Inventors: Robert E. Hager, Schaumburg; Laurence H. Moss, Hoffman Estates, both of Ill.

[73] Assignee: Zenith Radio Corporation, Glenview, Ill.

[21] Appl. No.: 306,448

[22] Filed: Sep. 28, 1981

[51] Int. Cl.[3] ..... H01J 40/14

[52] U.S. Cl. ..... 250/201; 354/1; 430/24

[58] Field of Search ..... 250/201, 205; 354/1; 430/24, 30

[56] References Cited

U.S. PATENT DOCUMENTS

| | | | |
|---|---|---|---|
| 3,949,226 | 4/1976 | Dugan et al. | 354/1 X |
| 4,053,904 | 10/1977 | Williams et al. | 430/24 X |
| 4,059,834 | 11/1977 | Hosokoshi et al. | 354/1 |

*Primary Examiner*—David C. Nelms
*Assistant Examiner*—Edward P. Westin

[57] ABSTRACT

A method and apparatus are disclosed for altering the exposure time of a master timer in a CRT light house to accommodate masks having different aperture sizes. For each expected aperture size, an exposure time modifier is pre-stored, the aperture size of a mask is sensed, and the modifier corresponding to the mask's aperture size is automatically selected. The selected modifier is used to alter the rate at which the master timer times out so as to provide an exposure interval appropriate for the mask being processed.

12 Claims, 3 Drawing Figures

AUTOMATIC CRT EXPOSURE REGULATION

BACKGROUND OF THE INVENTION

This invention is generally directed to improvements in CRT (cathode ray tube) manufacture. It is more specifically directed to an improved controller for adjusting the exposure time of a conventional light house on which CRT phosphors are exposed.

In the manufacture of CRTs, a so-called light house supports the faceplate of a CRT and its mask while a light source directs light through apertures in the mask to expose phosphors or other light sensitive materials on the screen of the CRT. The exposure time of the light house is critical and depends, in part, on the size of the apertures in the mask. For this reason, mask manufacturers measure the size of the apertures in each mask and segregate the masks according to aperture size. The exposure time of a light house is then pre-set to accommodate masks having a given aperture size. All masks of that size are then processed on the light house. To process masks of a different size, the exposure time of the light house is changed, and all masks of the new size are then processed.

The difficulty with the procedure described above is that masks must be segregated by size, and that segregation must be maintained. Inadvertent mixing of masks with different aperture sizes invariably produces rejects in the finished product. If the light house could accommodate masks with mixed aperture sizes, CRT production would be more easily accomplished.

Accordingly, it is a general object of the invention to provide an improved method of processing CRT screens and masks on a light house.

It is a more specific object of the invention to provide a method and apparatus for automatically controlling the exposure time of a light house to accommodate masks whose aperture size varies over a substantial range.

BRIEF DESCRIPTION OF THE FIGURES

The objects stated above and other objects of the invention are set forth more particularly in the following detailed description of the accompanying drawings, of which.

DESCRIPTION OF THE PREFERRED EMBODIMENT

Figure 1:
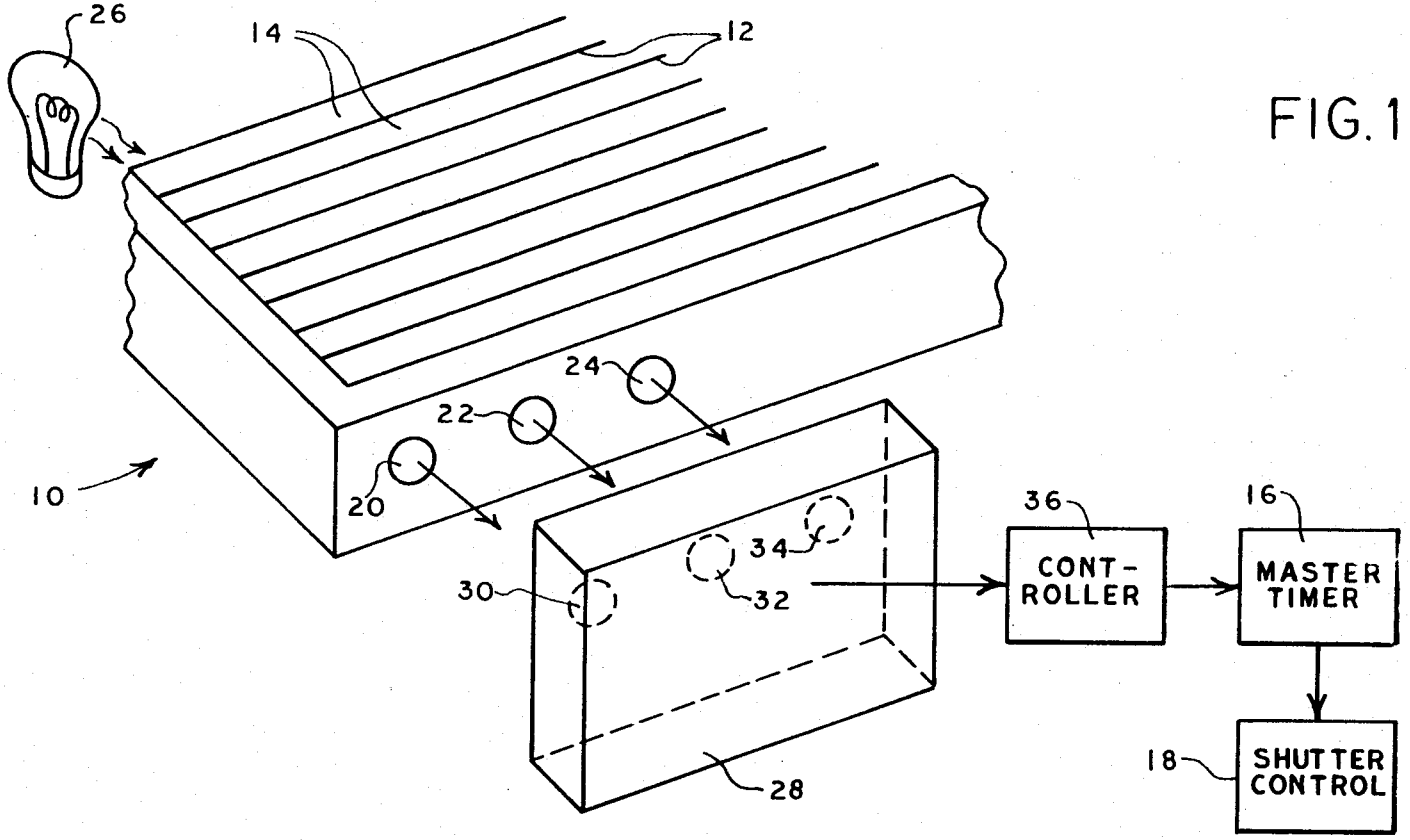
FIG. 1 schematically illustrates the method and apparatus by which the exposure time of a mask and its CRT screen are controlled in accordance with the invention.

Referring to FIG. 1, a portion of a CRT mask 10 is shown along with a schematic representation of the way in which exposure time of the mask is modified in accordance with the invention.

The illustrated mask 10 includes a plurality of electron barriers in the form of wires 12 which are tautly held by the mask's frame. When the mask is mated with an operating CRT (not shown) electrons from the CRT's gun pass through apertures 14 between the wires to excite phosphors deposited on the CRT's screen.

To properly align the phosphors on the CRT screen, the mask 10 is normally mated with a CRT screen, and both are mounted on a light house or exposure grill. A light source within the light house illuminates the CRT screen through the apertures 14 to render insoluble certain phosphor deposits thereon. Areas of the screen coating which are not illuminated are subsequently dissolved and washed away.

To limit the exposure time of the mask 10, a conventional master timer 16 is set to an exposure time appropriate for the mask 10. When the timer times out, it actuates a conventional shutter control 18 (usually part of the light house) to terminate exposure of the mask and the CRT screen to which it is mated.

As is well known in the art, the proper exposure time for the CRT depends on the size of the mask apertures 14. Hence, it is conventional to select masks of the same aperture size for processing on the light house so that the master timer 16 need not be manually reset each time a mask if processed. As set forth in detail below, masks of a given aperture size may be mixed with masks having different aperture sizes and all may be processed on the same light house without manually changing the setting of the master time 16.

To accomplish this goal, masks are provided which carry indicia representative of their aperture sizes. For example, the mask 10 is shown with three holes 20, 22 and 24 in its skirt. The open or closed condition of each hole indicates the size of the mask apertures. Thus, if the hole 24 is open and the holes 20 and 22 are closed, the mask 10 is identified as having apertures of size 1, for example. If holes 20 and 22 are open while the hole 24 is closed, this may indicate that the mask has size 6 apertures. Hence, the three holes provide the possibility of identifying up to seven aperture sizes and a mask reject (all holes closed). Of course, any number of such holes may be used, depending on the number of aperture sizes which are likely to be encountered.

Preferably, the open or closed condition of the holes 20, 22 and 24 is sensed while the mask is on the light house. For this purpose, a light source 26 is mounted in or on the light house so as to direct light through those holes which are open. A light sensor 28, also disposed in or on the light house, includes three photocells 30, 32 and 34 situated to receive light passing through those holes which are open. Because the open or closed condition of the three holes identifies aperture size, the signal output of the sensor 28 corresponds to a BCD (binary coded decimal) representation of aperture size.

As stated above, the master timer 16 is conventionally set to an exposure time appropriate for a single, given aperture size. Herein, however, the timer 16 is preferably set at or lower than the minimum exposure time required for all aperture sizes. For example, if it is expected that masks of three different aperture sizes will be processed, the timer 16 is set to the exposure time required for the largest aperture size. Masks whose aperture sizes are smaller require a longer exposure time.

To process masks having different aperture sizes, a plurality of exposure time modifiers are selected, one for each mask size. Preferably, each modifier represents the percentage by which the time set in the timer 16 is to be incremented. Thus, if the timer 16 is set for two seconds for aperture size 1 (the largest aperture size) the modifiers for sizes 2 and 3 may represent increases of 10% and 20%, for example, in the two second exposure time.

After the modifiers have been selected, the aperture size is detected by the sensor 28, and the modifier which corresponds to that detected mask size is selected, as by a controller 36. Exposure of the mask 10 and its CRT screen is initiated, the exposure time of the timer 16 is incremented, if necessary, by the selected modifier, and exposure is terminated when the timer reaches its altered exposure time. If the mask being sensed has apertures of the maximum size, no alternation in the setting of the timer 16 is necessary, assuming that it had been preset to terminate exposure at the appropriate time.

Figure 2:
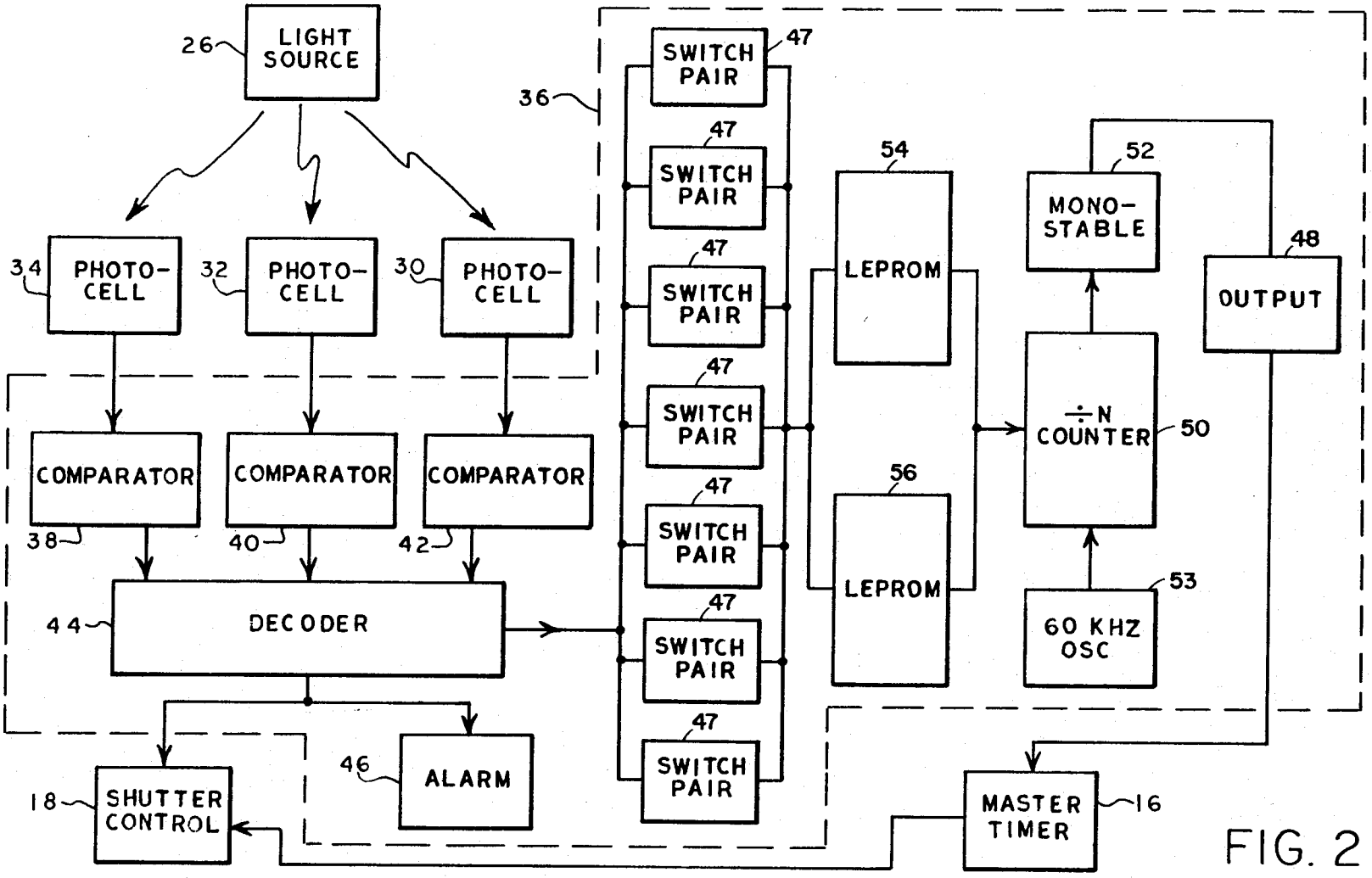
FIG. 2 is a block diagram of the controller shown in FIG. 1.

To effect the steps described above, the controller 36 may be constructed as illustrated in FIG. 2. As shown, the controller includes comparators 38, 40 and 42, each of which receives the output of one photocell. The function of the comparators is to discriminate against ambient noise and to develop outputs only in response to signals from the photocells.

Each of the comparators feeds a decoder 44 whose function is to determine aperture size based on the outputs of the comparators. If no input is received from the comparators, this indicates that the mask being processed had no open holes (a reject), that the mask is improperly mounted on the light house, or that a malfunction has occurred. In that event, the decoder may actuate an alarm 46 to alert the light house operator and also actuate the shutter control 18 so as to close the shutter in the light house. With the shutter closed, the operator may remove the mask from the light house without being exposed to the light source therein.

Also included in the controller are a plurality of switch pairs 47, one pair for each expected aperture size. These are manually adjustable switches which are set by an operator to indicate the degree to which the master timer 16 is to be incremented. Thus, the switch pair associated with size 2 apertures may be set to indicate that, when a size 2 mask is sensed, the exposure time set in timer 16 is to be incremented by 20%. The settings of these various switches thus corresponds to the exposure time modifiers discussed above. Two switches are included in each switch pair, one for units and one for tens so that a two digit percentage entry may be made.

Referring briefly to the timer 16, it is of the type which is energized by AC power and which keeps time by detecting the cycles of the AC power. The remainder of the controller alters the frequency of the power applied to the timer so as to enlarge its exposure time. That is, the timer 16 is caused to run slower in response to the modifiers stored in the settings of the switches 46.

Coupled to the timer 16 is an output circuit 48. This device couples to the timer AC power whose frequency is varied, depending on the aperture size of the mask being processed. Thus, if the mask being processed requires a longer exposure time than is preset in the timer 16, the frequency of the AC power from the output circuit 48 is lowered to cause the timer to run more slowly.

The AC signal applied to the timer 16 is developed by a divide-by-N counter 50 and applied to the output circuit via a monostable multivibrator circuit 52. The counter receives a 60 cycle clock signal from an oscillator 53 and divides the frequency of the oscillator signal by a number N. N may be unity where the exposure time need not be altered and may be a higher number when the exposure time is to be augmented.

To cause the counter to divide by the proper number, memory means in the form of a pair of LEPROMs (Light Erasable Programmable Read Only Memories) 54 and 56 are included. These devices store data representative of the divisor to be used by the counter 50 for each aperture size. The various divisors are stored in the LEPROMs at addresses which are selected by the switch pairs 47. Thus, when the decoder 44 identifies the aperture size of the mask being processed, it selects one of the switch pairs 47. The selected switch pair outputs the appropriate address to the LEPROMs 54 and 56 which, in turn, output a stored divisor to the counter 50. The latter device divides the clock frequency by the received divisor and outputs a divided down AC signal for controlling the rate at which the timer 16 times out.

Whenever the decoder 44 senses that a mask having a different aperture size is to be processed, it selects the appropriate switch pair. The percentage by which the timer is to be incremented is output as an address to the LEPROMs which, in turn, apply a different stored number N to the counter 50. The latter device then changes the frequency of its output signal according to the new value of N, and the timer 16 times out at the appropriate time for terminating exposure.

Figure 3:
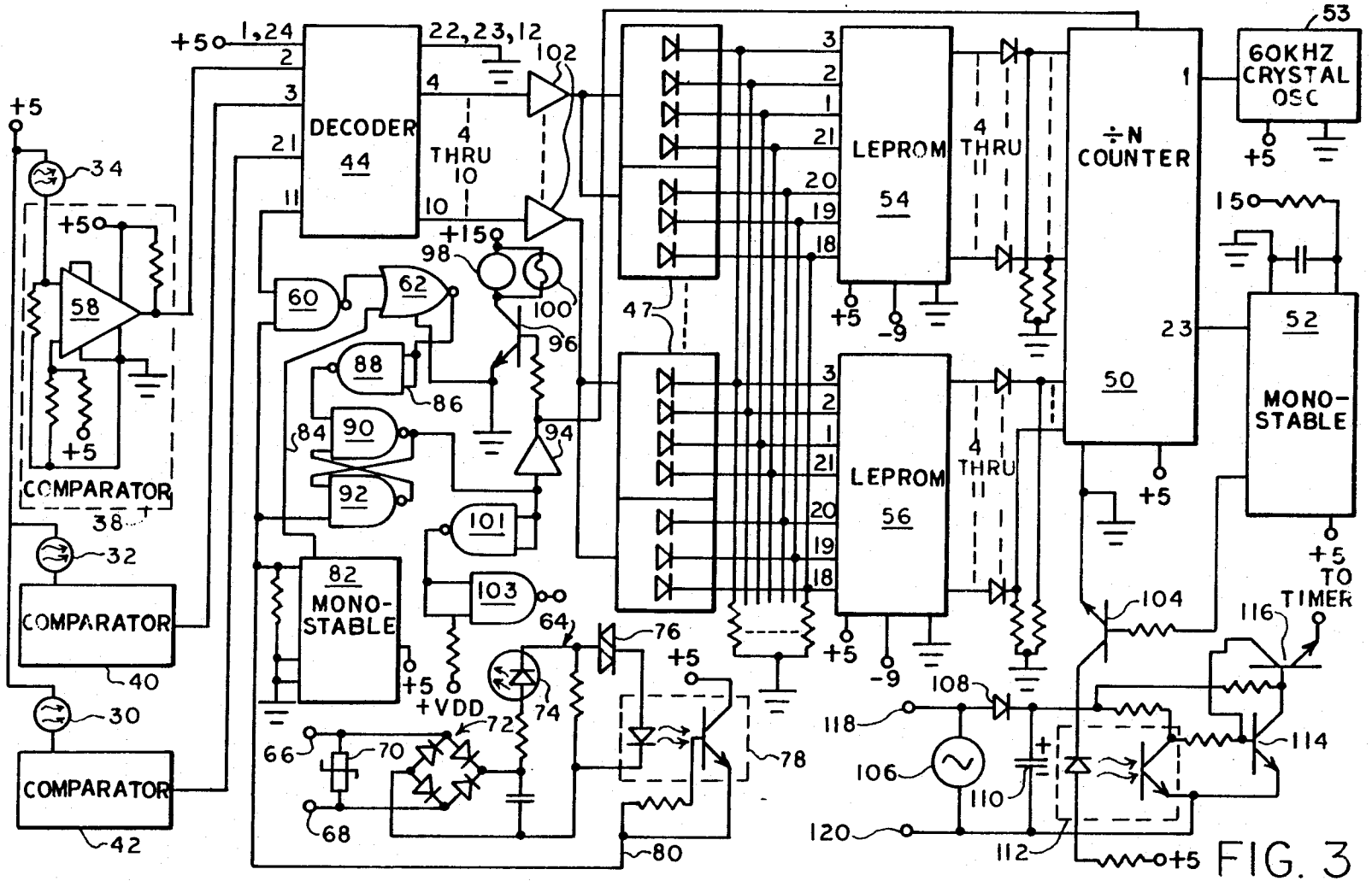
FIG. 3 is a schematic diagram which illustrates the controller in more detail.

Referring now to FIG. 3, a more detailed circuit diagram is shown to illustrate how the circuitry of FIG. 2 may be implemented. FIG. 3 also shows additional details of an alarm function not previously described.

As shown, the photocell 34 is coupled to an amplifier 58 which comprises part of the comparator 38. The photocells 32 and 30 couple their outputs to comparators 40 and 42 which may be identical to the comparator 38. The outputs of the three comparators are applied to pins 2, 3 and 21 of the decoder 44 which may be a type MC 14514B device.

Pin 11 of the decoder provides an alarm signal in the absence of inputs from the photocells. That alarm signal is coupled to a NAND gate 60 which drives another gate 62. To avoid generating a premature alarm, the gate is held off for about one second after power is applied to the shutter in the light house. For this purpose, the circuitry indicated generally by the reference numeral 64 receives 110 volt AC power at terminals 66 and 68. This is the same AC power which is used to open the shutter in the light house, and it is applied across a surge protection device 70 and a rectifier 72. An LED 74 is coupled to the rectifier to indicate when power is applied. The voltage coupled through the LED feeds a diac 76 and an optical isolator 78 to provide a 5 volt output on lead 80.

A monostable device 82 receives the 5 volt signal on lead 80 to provide a delayed output to the gate 62 via a lead 84, and gate 60 receives the 5 volt signal carried by the lead 80. With this arrangement, the gates 60 and 62 operate to provide an alarm signal on a lead 86 only when the decoder senses no output from the photocells and when the time delay set by the monostable 82 has expired.

The alarm signal on lead 86 is coupled to a latch comprising gates 88, 90 and 92. The output of the latch is applied to a driver 94 which energizes a transistor 96 for turning on an alarm 98 and an alarm lamp 100. Gates 101 and 103 also receive the output of the latch to energize a relay (not shown) for closing the shutter in the light house.

Returning to the decoder 44, its pins 4 through 10 carry a digital signal identifying the aperture size of the mask being processed. Buffers 102 each couple one bit of this signal to seven switch pairs 47 for selecting the switch pair associated with the sensed aperture size.

The outputs of the switch pairs 47 are coupled, as shown, to the address inputs of LEPROMS 54 and 56 for accessing the proper divisor stored therein. A digital representation of the accessed divisor is coupled through the illustrated diodes to the inputs of the counter 50, pin 1 of which receives a 60 cycle clock signal from the oscillator 53.

The divided output of the counter 50 appears at pin 23 and comprises narrow pulses which are stretched by the monostable 52 and applied to a transistor 104. The collector of the transistor 104 is coupled to a network which includes the light house's shutter solenoid 106, a rectifier 108, a smoothing capacitor 110, an optical coupler 112, and output transistors 114 and 116. The solenoid 106 receives 110 volt AC power at terminals 118 and 120, and the transistor 104 actuates the optical isolator to provide 110 volt output pulses which, at the emitter of transistor 116, have a frequency determined by the divisor output from the LEPROMs. These output pulses are coupled to the master timer to control its timing as previously described.

From the foregoing description, it will be apparent that the present exposure regulating system eliminates the need for feeding masks of one aperture size to a light house. Masks of various aperture sizes may be mixed without the need to manually change the timing of the master timer.

Although the invention has been described in terms of preferred steps carried out by a preferred exposure regulator, it will be obvious to those skilled in the art that many alterations and modifications may be made without departing from the invention. Accordingly, it is intended that all such alterations and modifications be considered as within the spirit and scope of the invention as defined by the appended claims.

What is claimed is:

1. In a CRT manufacturing operation which includes a light house for exposing a coated CRT screen and a mated mask to a source of illumination, and which includes a master timer for controlling exposure time, a method for automatically changing exposure time to accommodate masks having different aperture sizes, comprising:

providing masks which carry indicia representative of their aperture size;

setting the master timer to a predetermined exposure time;

preselecting a plurality of exposure time modifiers, one for each expected mask aperture size;

sensing the indicia carried by a mask to be exposed, and automatically selecting the exposure time modifier which corresponds to the aperture size of that mask;

initiating exposure;

altering the predetermined exposure time of the master timer by the exposure time modifier which was selected in response to sensing the indicia carried by the mask; and automatically terminating exposure when the master timer reaches its altered exposure time.

2. A method as set forth in claim 1 wherein sensing the mask indicia is effected while the mask is supported by the light house.

3. A method as set forth in claim 1 wherein said indicia is in the form of at least one size-identifying hole in the mask, and said indicia sensing includes directing light through the hole and detecting light which passes through the hole.

4. A method as set forth in claim 3 wherein the number and size of identifying holes is selected and the indicia sensing is effected so as to interpret detected light as a binary coded decimal representation of mask aperture size.

5. A method as set forth in claim 1 wherein the master timer is set to a minimum exposure time, and wherein the exposure modifiers are selected so as to increment the minimum exposure time.

6. A method as set forth in claim 1 wherein said exposure modifiers are stored in memory and read out after sensing the aperture size indicia.

7. A method as set forth in claim 6 wherein said master timer operates on AC power, and wherein the alteration of the timer's exposure time is effected by changing the frequency of the AC power according to the value of the selected modifier.

8. In a CRT manufacturing operation which includes a light house for exposing a coated CRT screen and a mated mask to a source of illumination, and which includes a master timer for limiting exposure to a preset time, an exposure regulator for automatically changing exposure time to accommodate masks having different aperture sizes, comprising:

means for selecting and storing a plurality of exposure time modifiers, one for each expected mask aperture size;

means for sensing the aperture size of the mask to be exposed;

decoding means responsive to a sensed mask aperture size for selecting one of said modifiers; and means coupled to the master timer and responsive to the selected modifier for altering the preset exposure time of the master timer in accordance with the selected modifier so as to set exposure time to correspond with the sensed aperture size.

9. An exposure regulator as set forth in claim 8 wherein said means for selecting and storing the exposure time modifiers includes a plurality of manually operable switches, one for each aperture size, which are adapted to be set to times indicative of the amount by which the preset time of the master timer is to be modified.

10. An exposure regulator as set forth in claim 9 wherein the master timer keeps time in response to AC power applied to it, and wherein said means for altering the master timer's preset exposure time responds to a selected exposure time modifier for altering the frequency of the AC power applied to the master timer.

11. An exposure regulator as set forth in claim 10 wherein said means for altering the master timer's exposure time includes a divide-by-N counter receiving an AC clock signal, memory means storing data representative of a plurality of values for N and responsive to a selected switch for coupling to the counter a value of N such that the counter divides its clock signal by N, and means for coupling the divided clock signal to the master timer so that it keeps time in accordance with the frequency of the divided clock signal.

12. In a CRT manufacturing operation which includes a light house for exposing a coated CRT screen and a mated mask to a source of illumination, and which includes a master timer for limiting exposure to a preset time, an exposure regulator for automatically changing exposure time to accommodate masks having different aperture sizes, comprising:

a plurality of switches, one for each aperture size, for selecting and storing data indicative of the percentage by which the master timer's preset exposure time is to be incremented for proper exposure of masks of each aperture size;

means including photocells for sensing the aperture size of a mask to be exposed;

decoding means responsive to a sensed aperture size for accessing a switch associated with the sensed aperture size;

memory means for storing data representative of a plurality of divisors, each divisor being associated with a different aperture size and being selected to reflect the extent to which the master timer's preset time is to be incremented, the memory means being addressed by a switch selected by the decoding means for outputting a selected divisor;

a counter receiving an AC clock signal and the divisor output by the memory means for developing an AC output signal whose frequency is equal to the clock signal frequency divided by the received divisor; and means for applying the counter's output signal to the master timer such that the master timer keeps time in accordance with the frequency of the counter's output signal and thereby terminates exposure time in accordance with the setting of the selected switch.

* * * * *